US008857034B2

(12) United States Patent
Schaefer et al.

(10) Patent No.: US 8,857,034 B2
(45) Date of Patent: Oct. 14, 2014

(54) METHOD FOR MANUFACTURING A DISHWASHER APPLIANCE

(75) Inventors: Brandon K G Schaefer, Louisville, KY (US); Stephen Bernard Froelicher, Shepherdsville, KY (US); Suzanne Marie Damaske, Taylorsville, KY (US)

(73) Assignee: General Electric Company, Schenectady, NY (US)

( * ) Notice: Subject to any disclaimer, the term of this patent is extended or adjusted under 35 U.S.C. 154(b) by 217 days.

(21) Appl. No.: 13/565,061

(22) Filed: Aug. 2, 2012

(65) Prior Publication Data

US 2014/0033497 A1 Feb. 6, 2014

(51) Int. Cl.
*B23P 21/00* (2006.01)

(52) U.S. Cl.
USPC ..... 29/469

(58) Field of Classification Search
USPC ..... 29/428, 469; 312/228; 49/501; 134/56 D, 115 R
See application file for complete search history.

(56) References Cited

U.S. PATENT DOCUMENTS

| | | | | |
|---|---|---|---|---|
| 6,736,470 | B2 * | 5/2004 | Manke et al. | 312/228 |
| 7,748,796 | B2 | 7/2010 | Rockwell et al. | |
| 2009/0102336 | A1 | 4/2009 | Buehlmeyer et al. | |
| 2010/0192990 | A1 | 8/2010 | Hotz et al. | |
| 2012/0013228 | A1 | 1/2012 | Fritz et al. | |

* cited by examiner

*Primary Examiner* — John C Hong
(74) *Attorney, Agent, or Firm* — Dority & Manning, P.A.

(57) ABSTRACT

A method for manufacturing a dishwasher appliance is provided. A set of interchangeable tubs with a metal tub and a plastic tub and a set of interchangeable of inner door panels with a metal inner door panel and an outer door panel are provided. One of the set of interchangeable inner door panels is mounted to one of the set of interchangeable tubs to assemble the dishwasher appliance. The method can provide a dishwasher appliance with a metal inner door panel and a metal tub, a metal inner door panel and a plastic tub, a plastic inner door panel and a metal tub, or a plastic inner door panel and a plastic tub.

16 Claims, 7 Drawing Sheets

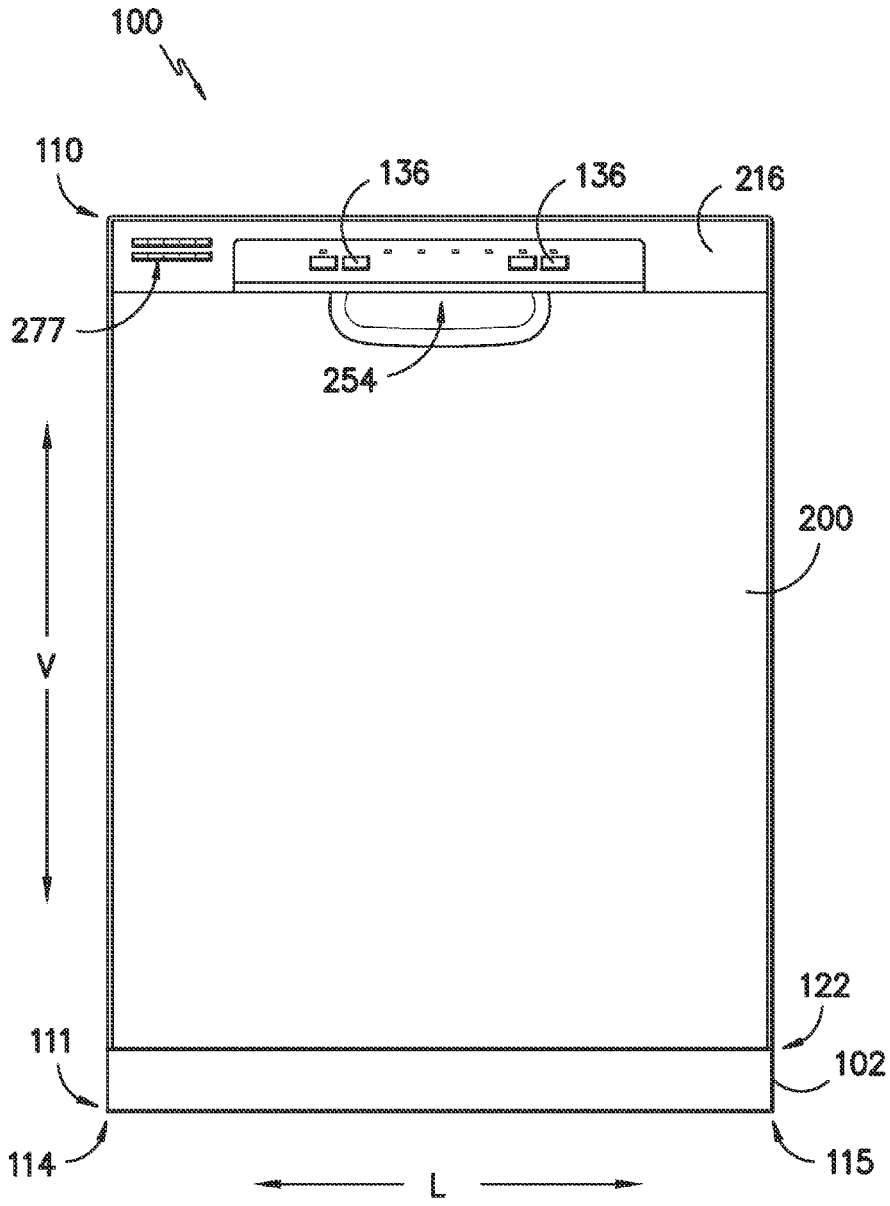
FIG. —1—

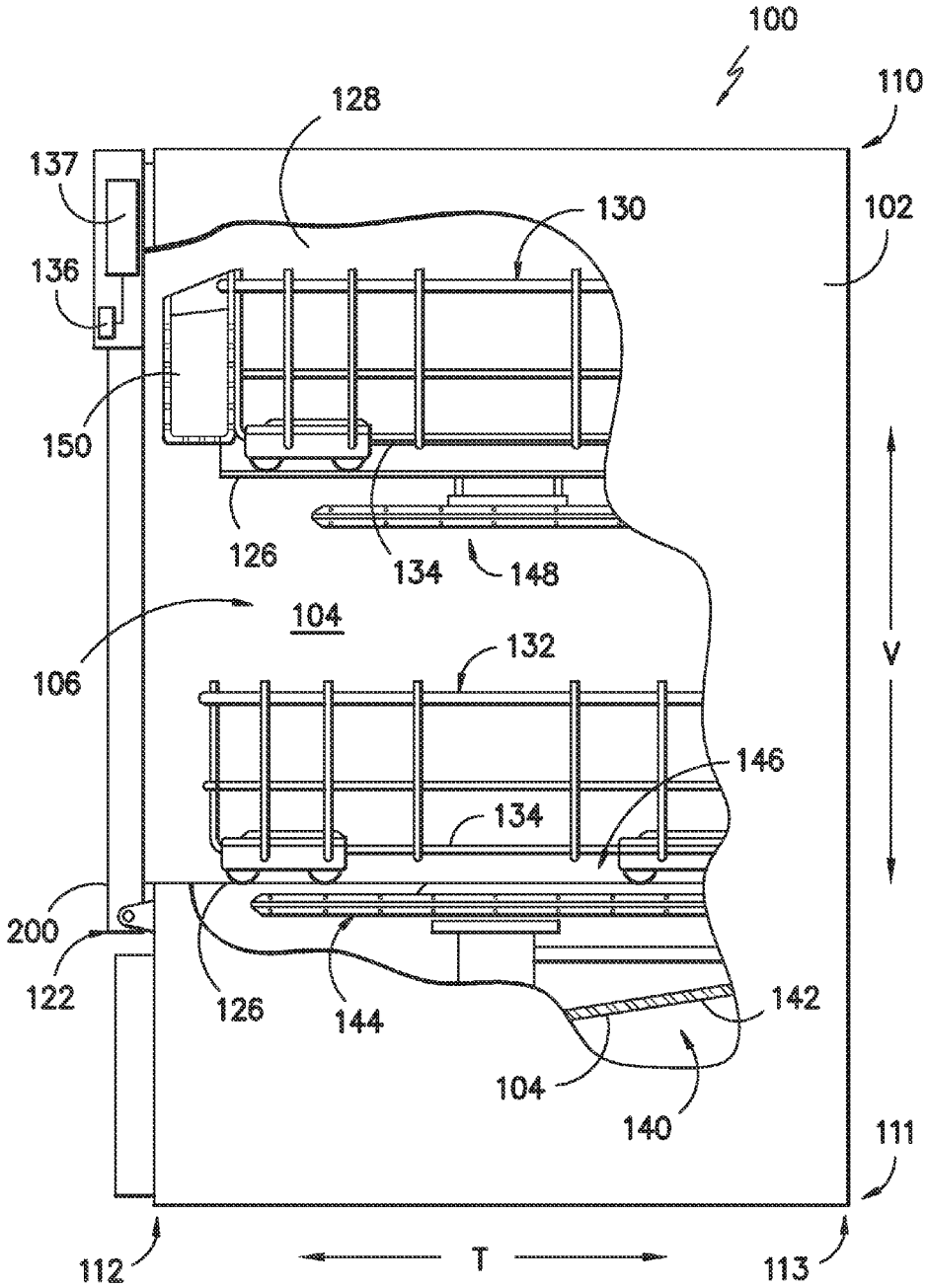
FIG. —2—

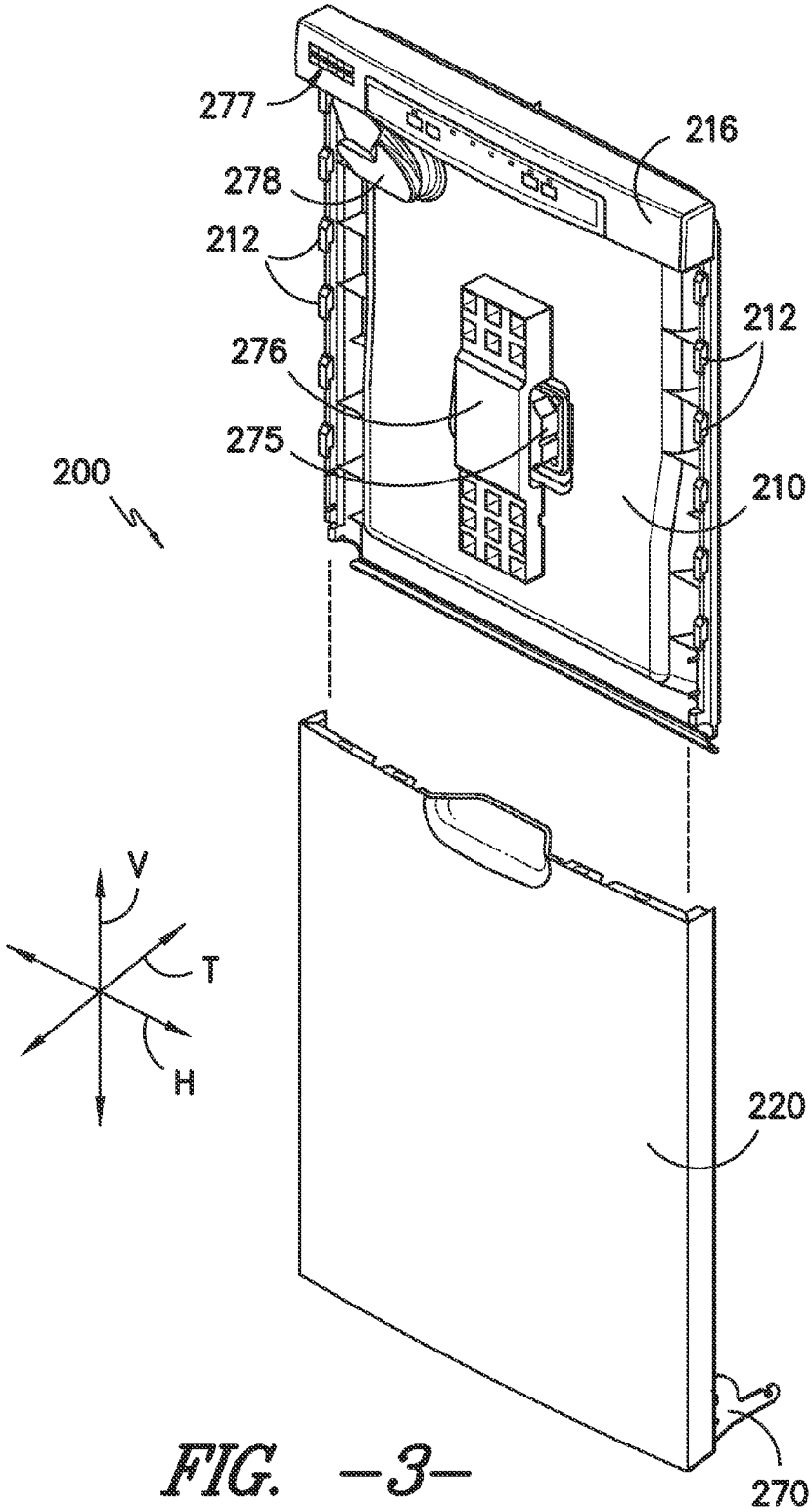
FIG. —3—

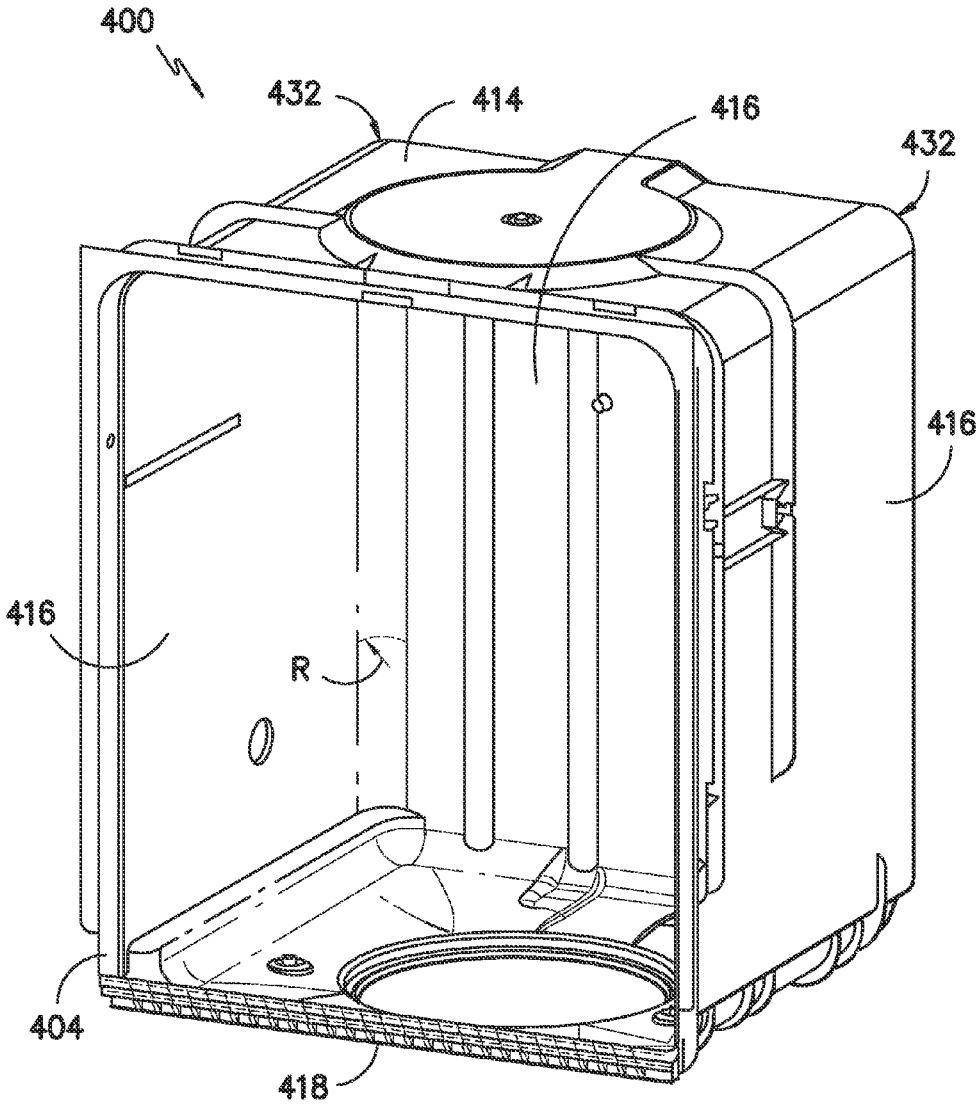
FIG. —6—

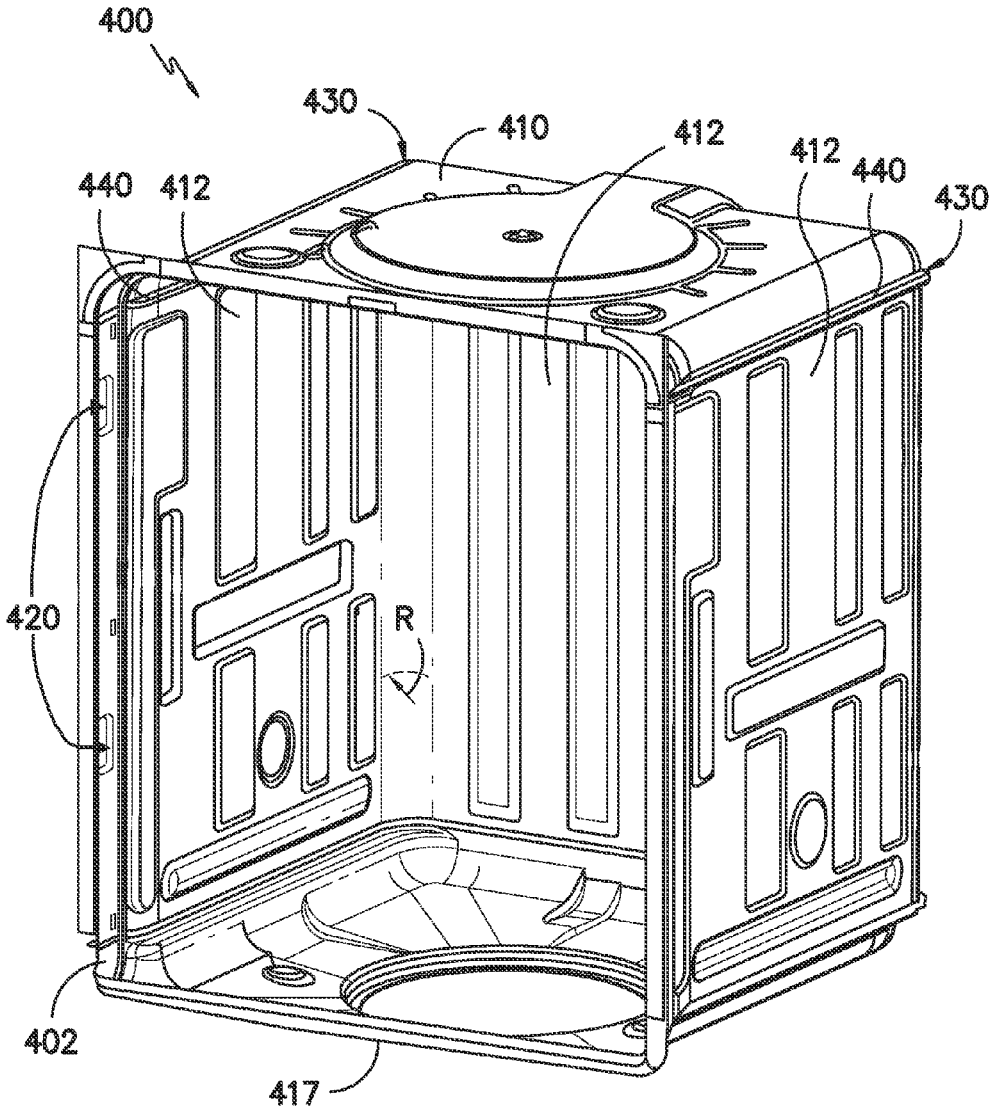
FIG. —7—

METHOD FOR MANUFACTURING A DISHWASHER APPLIANCE

FIELD OF THE INVENTION

The present subject matter relates generally to dishwasher appliances and methods for manufacturing the same.

BACKGROUND OF THE INVENTION

Dishwasher appliances generally include a tub that defines a wash chamber configured for receipt of articles for washing. A door is mounted proximate the tub and is configured for permitting selective access to the wash chamber of the tub. The door can include an inner door panel mounted to an outer door panel to form the door. The inner door panel assists with defining the wash chamber when the door is in a closed position.

Generally, dishwasher appliance manufacturers have two dishwasher product lines, a higher-end line and a lower-end line. The higher-end line is generally constructed of higher cost materials and components. As an example, the tub and inner door panel of a higher-end dishwasher appliance may be constructed of stainless steel. Conversely, the lower-end line is constructed of lower cost materials and components. As an example, the tub and inner door panel of a lower-end dishwasher appliance may be constructed of plastic.

Higher-end dishwasher appliances and lower-end dishwasher appliances generally have distinct designs and constructions such that components from a lower-end appliance are incompatible or not easily compatible with a higher-end appliance and vice versa. Such incompatibility can result in increased manufacturing costs due to separate components being required for each product line. Accordingly, a method for manufacturing higher-end and lower-end dishwasher appliances with common components or interchangeable components would be useful.

In addition, the variation between higher-end dishwasher appliances and lower-end dishwasher appliances can be significant. Further, it may desirable to combine certain components of lower-end dishwasher appliances with particular components of higher-end dishwasher appliances to manufacture a mid-range dishwasher appliance. Accordingly, a method for manufacturing dishwasher appliances with interchangeable components that permit construction of a lower-end dishwasher appliance, a mid-range dishwasher appliance, and a higher-end dishwasher appliance from the interchangeable components would be useful.

BRIEF DESCRIPTION OF THE INVENTION

The present subject matter provides a method for manufacturing a dishwasher appliance. A set of interchangeable tubs with a metal tub and a plastic tub and a set of interchangeable of inner door panels with a metal inner door panel and an outer door panel are provided. One of the set of interchangeable inner door panels is mounted to one of the set of interchangeable tubs to assemble the dishwasher appliance. The method can provide a dishwasher appliance with a metal inner door panel and a metal tub, a metal inner door panel and a plastic tub, a plastic inner door panel and a metal tub, or a plastic inner door panel and a plastic tub. Additional aspects and advantages of the invention will be set forth in part in the following description, or may be apparent from the description, or may be learned through practice of the invention.

In a first exemplary embodiment, a method for manufacturing a dishwasher appliance is provided. The method includes providing a set of interchangeable dishwasher tubs and supplying a set of interchangeable dishwasher inner door panels. The set of interchangeable dishwasher tubs includes a plastic dishwasher tub and a metal dishwasher tub. The set of interchangeable inner door panels includes a plastic inner door panel and a metal inner door panel. One of the set of interchangeable dishwasher tubs and one of the set of interchangeable inner door panels is selected. The selected one of the set of interchangeable inner door panels is mounted to the selected one of the set of interchangeable dishwasher tubs in order to assemble the dishwasher appliance. The dishwasher appliance includes one of the plastic dishwasher tub and the plastic inner door panel, the plastic dishwasher tub and the metal inner door panel, the metal dishwasher tub and the metal inner door panel, or the metal dishwasher tub and the plastic inner door panel.

In a second exemplary embodiment, a method for manufacturing a dishwasher appliance is provided. The method includes providing a plastic dishwasher tub and supplying a set of interchangeable dishwasher inner door panels. The set of interchangeable dishwasher inner door panels includes a plastic inner door panel and a metal inner door panel. One of the set of interchangeable dishwasher inner door panels is selected. The selected one of the set of interchangeable dishwasher inner door panels is mounted to the plastic dishwasher tub in order to assemble the dishwasher appliance. The dishwasher appliance includes either the plastic dishwasher tub and the plastic dishwasher inner door panel or the plastic dishwasher tub and the metal dishwasher inner door panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 provides a front view of a dishwasher appliance according to an exemplary embodiment of the present subject matter with an exemplary embodiment of a door assembly mounted to a cabinet of the dishwasher appliance.

FIG. 2 provides a side view of the dishwasher appliance of FIG. 1 with a portion of the cabinet removed to reveal an interior of the dishwasher appliance.

FIG. 3 illustrates an exploded view of the door assembly of FIG. 1.

FIGS. 6 and 7 illustrate perspective views of a set of tubs according to an exemplary embodiment of the present subject matter.

DETAILED DESCRIPTION

Figure 5:
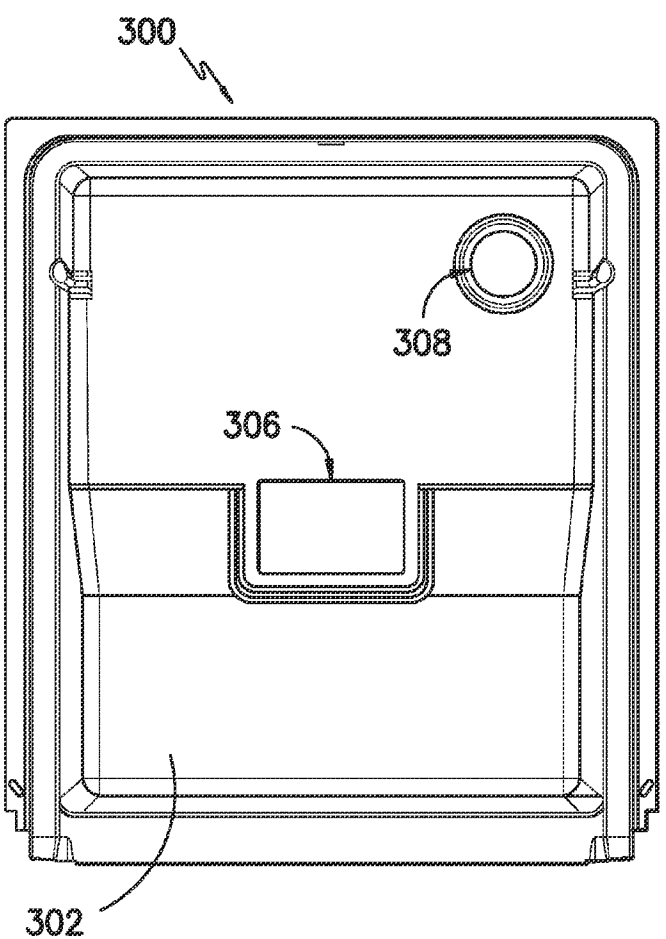
FIGS. 4 and 5 illustrate front views of a set of inner door panels according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 depict an exemplary domestic dishwasher appliance 100 that may be configured in accordance with aspects of the present disclosure. The dishwasher appliance 100 includes a cabinet 102 having a tub 104 therein that defines a wash chamber 106. The tub 104 includes a door assembly 200 hinged at its bottom 122 for movement between a normally closed configuration (shown in FIGS. 1 and 2) in which wash chamber 106 is sealed shut, e.g., for washing operation, and an open configuration, e.g., for loading and unloading of articles from dishwasher appliance 100.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

Turning to FIG. 2, guide rails 126 are mounted on tub side walls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash chamber 106, and a retracted position (shown in FIGS. 1 *and* 2) in which the rack is located inside the wash chamber 106.

A silverware basket 150 is removably mounted to upper rack assembly 130. However, silverware basket 150 may also be selectively attached to other portions of dishwasher appliance 100, e.g., lower rack 132 or door assembly 200. Silverware rack 150 is configured for receipt of silverware, utensils, and the like, that are too small to be accommodated by the upper and lower racks 130, 132.

The dishwasher appliance 100 further includes a lower spray assembly 144 that is mounted within a lower region 146 of the wash chamber 106 and above a tub sump portion 142 so as to be in relatively close proximity to the lower rack 132. A mid-level spray assembly 148 is located in an upper region of the wash chamber 106 and may be located in close proximity to upper rack 130. Additionally, an upper spray assembly (not shown) may be located above the upper rack 130.

The lower and mid-level spray assemblies 144, 148 and the upper spray assembly are fed by a fluid circulation assembly (not shown) for circulating water and dishwasher fluid in the tub 104. The fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the upper and lower racks 130, 132 and silverware basket 150. The lower and mid-level spray assemblies 144, 148 may be rotatably mounted in wash chamber 106. Accordingly, the arrangement of the discharge ports in at least the lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel 216 of door assembly 200 as shown. In such an embodiment, input/output ("I/O") signals may be routed between the control system and various operational components of dishwasher appliance 100 along wiring harnesses that may be routed through the bottom 122 of door assembly 200. Typically, the controller 137 includes a user interface panel 136 through which a user may select various operational features and modes and monitor progress of the dishwasher appliance 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher and that the embodiment depicted in FIGS. 1 and 2 is for illustrative purposes only. For example, the present subject matter may be used in dishwasher appliances having other rack configurations. Also, controller 137 may be located beneath tub 104, e.g., machinery compartment 140.

FIG. 3 illustrates an exploded view of door assembly 200. Door assembly 200 includes an inner door panel 210 and an outer door panel 220. Inner and outer door panels 210 and 220 are coupled or secured together with a plurality of projections 212 mounted to inner door panel 210 in order to form door assembly 200.

Inner door panel 210 includes a detergent dispenser 275 mounted to inner door panel 210 with a bracket 276. A user can fill detergent dispenser 275 with detergent prior to starting dishwasher appliance 100 (FIG. 1), and detergent dispenser 275 may dispense such detergent during operation of dishwasher appliance 100. Inner door panel 210 also includes a venting conduit 278 that is in fluid communication with wash chamber 106 of tub 104 and a vent 277 when door assembly 200 is in the closed position (shown in FIG. 2). Water vapor and/or steam can be directed out of wash chamber 106 through venting conduit 278 to vent 277, e.g., during a drying cycle of dishwasher appliance 100. Control panel 216 is also mounted to inner door panel 210. Door assembly 200 can be rotatably mounted to tub 104 and/or cabinet 102 with a hinge 270.

Figure 4:
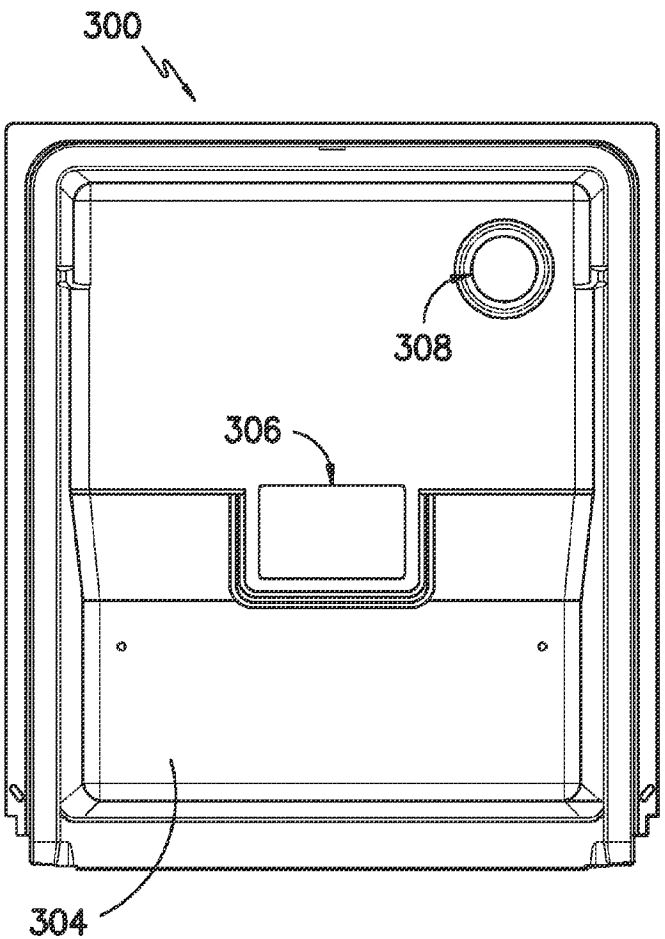

FIGS. 4 and 5 illustrate front views of a set of inner door panels 300 according to an exemplary embodiment of the present subject matter. Each inner door panel of set of inner door panels 300 is interchangeable. In particular, set of inner door panels 300 includes a metal inner door panel 302 (shown in FIG. 5) and a plastic inner door panel 304 (shown in FIG. 4). Metal inner door panel 302 and plastic inner door panel 304 are interchangeable despite differences in materials and construction of metal and plastic inner door panels 302 and 304. As an example, inner door panel 210 of door assembly 200 shown in FIG. 3 can be metal inner door panel 302 or plastic inner door panel 304, e.g., depending upon the inner door panel material desired.

Each inner door panel of set of inner door panels 300 defines an aperture 306 and an opening 308. Aperture 306 is configured to receive and mount detergent dispenser 275 (FIG. 3). Opening 308 is configured to receive or cooperate with venting conduit 278 (FIG. 3). Thus, steam or air within wash chamber 106 (FIG. 2) can flow through opening 308 to venting conduit 278. Aperture 306 and opening 308 are positioned at substantially the same location on both metal inner door panel 302 and plastic inner door panel 304 to permit interchangeability of detergent dispenser 275 and/or venting conduit 278 between metal and plastic inner door panels 302 and 304. Also, metal and plastic inner door panels 302 and 304 may be utilized with various front control and/or top control dishwasher FIGS. 6 and 7 illustrate perspective views of a set of tubs 400 according to an exemplary embodiment of the present subject matter. Each tub of set of tubs 400 is interchangeable. In particular, set of tubs 400 includes a metal tub 402 (shown in FIG. 7) and a plastic tub 404 (shown in FIG. 6). Metal tub 402 and plastic tub 404 are interchangeable despite differences in materials and construction of metal and plastic tubs 402 and 404. As an example, tub 104 of dishwasher appliance 100 shown in FIG. 2 can be metal tub 402 or plastic tub 404, e.g., depending upon the tub material desired. Metal tub 402 and metal inner door panel 302 may be constructed of any suitable metal, e.g., stainless steel.

As discussed above, FIGS. 4-7 illustrate set of inner door panels 300 and set of tubs 400. During assembly of dishwasher appliance 100 (FIG. 1), a selected one of set of inner doors panels 300 can be mounted for rotation relative to a selected one of set of tubs 400 to construct dishwasher appliance 100. The interchangeability of inner door panels of set of inner door panels 300 and tubs of set of tubs 400 permits a variety of dishwasher appliance 100 configurations. For example, as discussed in greater detail below, dishwasher appliance 100 may be assembled with one of the following configurations: (1) metal inner door panel 302 and metal tub 402; (2) metal inner door panel 302 and plastic tub 404; (3) plastic inner door panel 304 and metal tub 402; or (4) plastic inner door panel 304 and plastic tub 404. Thus, great flexibility in constructing dishwasher appliance 100 can be provided.

However, to permit interchangeability of inner door panels of set of inner door panels 300 and tubs of set of tubs 400, certain features or constructions may be necessary, e.g., due to differences between metal and plastic and design considerations inherent in manufacturing with either material. For example, a top panel 410 of metal tub 402 and sidewalls 412 of metal tub 402 can be joined with a roll seaming, welding or static process at a joint 440. Such roll seaming can require sidewalls 412 of metal tub 402 to meet at a corner 430 with a radius R in order to permit the process to provide a continuous seam between top panel 410 and sidewalls 412 as the process transitions from one of the sidewalls 412 to another of the sidewalls 412 at corner 430. Molding of plastic tub 404 may not require sidewalls 416 of plastic tub 404 to have the radius R. However, plastic tub 404 may be constructed with sidewalls 416 having the radius R to permit interchangeability of dishwasher components. Further, metal tub 402 can require a separate primary seal retainer (not shown) whereas the primary seal retainer may be integral with plastic tub 404.

As another example, certain features of dishwasher appliance 100 can be integrally molded during manufacture of plastic tub 404. Conversely, metal tub 402 may require similar components to be attached to metal tub 402. In particular, metal inner door panel 302 and plastic inner door panel 304 can both be mounted to outer door panel 220 with plurality of projections 212. Plurality of projections 212 can be integrally molded to plastic inner door panel 304. Conversely, plurality of projections 212 can be a separate component that is attached to metal inner door panel 302.

As a further example, a lip 417 of metal tub 402 may match a lip 418 of plastic tub 404. Such matching can result from iterating tub lip geometries between acceptable mold flow permitted in molding of plastic tub 404 and acceptable formability and hemming permitted during manufacturing of metal tub 402.

In yet another example, metal tub 402 is generally constructed of with thinner walls compared to plastic tub 404. In particular, sidewalls 412 of metal tub 402 can be thinner compared to sidewalls 416 of plastic tub 404. Metal tub 402 can include embossments 420 to account for such differences in thickness between metal tub 402 and plastic tub 404.

The features discussed above and other suitable features can permit interchangeability of inner door panels of set of inner door panels 300 and tubs of set of tubs 400. Such interchangeability can provide great flexibility in construction of dishwasher appliance 100 as discussed in greater detail below.

Figure 8:
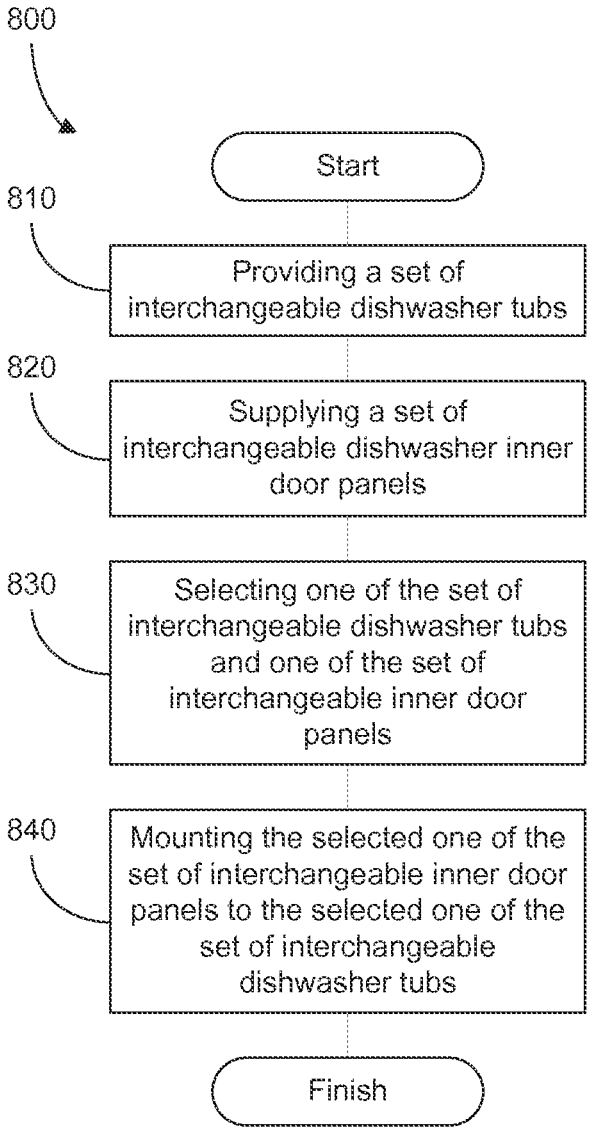
FIG. 8 illustrates a method for manufacturing a dishwasher appliance according to an exemplary embodiment of the present subject matter.

FIG. 8 illustrates a method 800 for manufacturing a dishwasher appliance, e.g., dishwasher appliance 100, according to an exemplary embodiment of the present subject matter. At step 810, set of interchangeable dishwasher tubs 400 is provided. As discussed above, set of interchangeable dishwasher tubs 400 includes plastic dishwasher tub 404 and metal dishwasher tub 402. At step 820, set of interchangeable dishwasher inner door panels 300 is supplied. As discussed above, set of interchangeable inner door panels 300 includes plastic inner door panel 304 and metal inner door panel 302.

At step 830, one of the set of interchangeable dishwasher tubs 400 and one of the set of interchangeable inner door panels 300 is selected. Selection of the one of the set of interchangeable dishwasher tubs 400 and the one of the set of interchangeable inner door panels 300 can be guided by various considerations. For example, a higher end dishwasher appliance may require metal dishwasher tub 402 and metal inner door panel 302 because a consumer may associate such components with higher quality or may be willing to pay more for a dishwasher appliance with such components. Conversely, a lower end dishwasher appliance may require plastic dishwasher tub 404 and plastic inner door panel 304 because such components are often cheaper than metal dishwasher tub 402 and metal inner door panel 302. Additionally, a mid-range dishwasher appliance may have plastic dishwasher tub 404 and metal inner door panel 302 to provide a consumer with high end features like the metal inner door panel 302 while lowering costs using the plastic dishwasher tub 404. Other design considerations may be used as well.

At step 840, the selected one of the set of interchangeable inner door panels 300 is mounted to the selected one of the set of interchangeable dishwasher tubs 400 in order to assemble dishwasher appliance 100. At step 840, dishwasher appliance 100 is provided with one of the following configurations: (1) plastic dishwasher tub 404 and plastic inner door panel 304; (2) plastic dishwasher tub 404 and metal inner door panel 302; (3) metal dishwasher tub 402 and metal inner door panel 302; or (4) metal dishwasher tub 402 and plastic inner door panel 304. Thus, method 800 provides a manufacturer or designer with flexibility in assembling dishwasher appliance 100 by utilizing interchangeable components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for manufacturing a dishwasher appliance, the method comprising:

providing a set of interchangeable dishwasher tubs, the set of interchangeable dishwasher tubs comprising:

a plastic dishwasher tub; and a metal dishwasher tub;

supplying a set of interchangeable dishwasher inner door panels, the set of interchangeable inner door panels comprising:

a plastic inner door panel; and a metal inner door panel;

selecting one of the set of interchangeable dishwasher tubs and one of the set of interchangeable inner door panels;

coupling the selected on of the set of interchangeable dishwasher inner door panels to a dishwasher outer door panel in order to form a dishwasher door assembly; and mounting the dishwasher door assembly to the selected one of the set of interchangeable dishwasher tubs in order to assemble the dishwasher appliance such that the dishwasher appliance comprises one of:

the plastic dishwasher tub and the plastic inner door panel;

the plastic dishwasher tub and the metal inner door panel;

the metal dishwasher tub and the metal inner door panel; or the metal dishwasher tub and the plastic inner door panel.

2. The method of claim 1, wherein each inner door panel of the set of interchangeable dishwasher inner door panels defines an aperture configured for receipt of a detergent dispenser.

3. The method of claim 2, further comprising fixing the detergent dispenser within the aperture of the selected one of the set of interchangeable dishwasher inner door panels.

4. The method of claim 1, wherein each inner door panel of the set of interchangeable dishwasher inner door panels defines an opening configured for engaging a venting conduit.

5. The method of claim 4, further comprising positioning the venting conduit at the opening of the selected one of set of interchangeable dishwasher inner door panels.

6. The method of claim 1, further comprising securing a control panel assembly to the selected one of set of interchangeable dishwasher inner door panels.

7. The method of claim 1, wherein each dishwasher tub of the set of interchangeable dishwasher tubs defines a wash chamber.

8. The method of claim 7, further comprising arranging a spray assembly within the wash chamber of the selected one of the set of interchangeable dishwasher tubs.

9. The method of claim 7, further comprising assembling a rack assembly within the wash chamber of the selected one of the set of interchangeable dishwasher tubs.

10. The method of claim 7, further comprising fixing a heating element within the wash chamber of the selected one of the set of interchangeable dishwasher tubs.

11. A method for manufacturing a dishwasher appliance, the method comprising:

providing a plastic dishwasher tub;

supplying a set of interchangeable dishwasher inner door panels, the set of interchangeable dishwasher inner door panels comprising:

a plastic inner door panel; and a metal inner door panel;

selecting one of the set of interchangeable dishwasher inner door panels;

coupling the selected one of the interchangeable dishwasher inner door panels to a dishwasher outer door panel in order to form a dishwasher door assembly; and mounting the dishwasher door assembly to the plastic dishwasher tub in order to assemble the dishwasher appliance such that the dishwasher appliance comprises either:

the plastic dishwasher tub and the plastic dishwasher inner door panel; or the plastic dishwasher tub and the metal dishwasher inner door panel.

12. The method of claim 11, wherein each inner door panel of the set of interchangeable dishwasher inner door panels defines an aperture configured for receipt of a detergent dispenser.

13. The method of claim 12, further comprising fixing the detergent dispenser within the aperture of the selected one of the set of interchangeable dishwasher inner door panels.

14. The method of claim 11, wherein each inner door panel of the set of interchangeable dishwasher inner door panels defines an opening configured for engaging a venting conduit.

15. The method of claim 14, further comprising positioning the venting conduit at the opening of the selected one of set of interchangeable dishwasher inner door panels.

16. The method of claim 11, further comprising securing a control panel assembly to the selected one of set of interchangeable dishwasher inner door panels.

* * * * *